US006190067B1

(12) United States Patent
Kobayashi et al.

(10) Patent No.: US 6,190,067 B1
(45) **Date of Patent: *Feb. 20, 2001**

(54) CASSETTE CONTAINING MAGNETICALLY AFFIXABLE PRINTING TAPE

(75) Inventors: Kenji Kobayashi, Akiruno; Kenzo Ito, Kodaira; Kenji Igarashi, Tokyo; Masayuki Ikeda, Kawaguchi; Kensaku Takeuchi, Kokubunji; Kenji Suyama, Ome; Satoshi Kimura, Ome; Koji Deguchi, Ome, all of (JP)

(73) Assignee: Casio Computer., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/395,658

(22) Filed: Sep. 14, 1999

(30) Foreign Application Priority Data

Sep. 21, 1998 (JP) ..... 10-266941
Nov. 5, 1998 (JP) ..... 10-314928

(51) Int. Cl.[7] ..... B41J 35/28
(52) U.S. Cl. ..... 400/207; 400/208
(58) Field of Search ..... 400/207, 208; 428/64.3, 65.3, 141, 323, 329; 283/82; 402/503

(56) References Cited

U.S. PATENT DOCUMENTS 4,100,011 * 7/1978 Foote ..... 283/82
4,231,828 * 11/1980 Mintz ..... 283/82
4,899,037 * 2/1990 Marechal et al. ..... 283/82
5,374,132 * 12/1994 Kimura ..... 400/587
5,411,798 5/1995 Funae et al. ..... 428/341
5,474,249 * 12/1995 Koizumi et al. ..... 242/526
5,559,642 * 9/1996 Hoogendoorn et al. ..... 360/27
5,744,234 * 4/1998 Kitaori et al. ..... 428/332
5,764,457 * 6/1998 Uhde et al. ..... 360/132
5,828,385 * 10/1998 Smith et al. ..... 346/74.2
5,841,613 * 11/1998 DeMaster et al. ..... 360/128
5,883,698 * 3/1999 Kimura ..... 355/38

FOREIGN PATENT DOCUMENTS 0 426 116 A2 5/1991 (EP) .
0 661 169 A1 7/1995 (EP) .
196283 * 11/1984 (JP) ..... 400/207

* cited by examiner

*Primary Examiner*—John S. Hilten
*Assistant Examiner*—Anthony H. Nguyen
(74) *Attorney, Agent, or Firm*—Frishauf, Holtz, Goodman, Langer & Chick, P.C.

(57) ABSTRACT

A tape cassette which contains a roll of a magnetically affixable printing tape formed around a holding reel and a roll of an ink ribbon formed around a holding reel and having a non-magnetic ink layer formed on the ribbon is set in a cassette accommodating section of a tape printer. The printing tape and the ink ribbon are fed out from their holding reels within the cassette across a cut in the tape cassette and through between a thermal head and a platen roller while being pressed by those elements to thereby perform printing. The printing tape comprises a printing layer and a magnetic layer pasted to the printing layer. S and N poles which extend lengthwise of the tape are alternately arranged widthwise on the magnetic layer. Thus, two overlapping poles of any two adjacent turns of the tape have the same polarity at any peripheral position. Thus, a relatively small force is required to draw the printing tape out from the tape cassette, and stabilized conveyance of the tape and satisfactory printing are achieved.

8 Claims, 11 Drawing Sheets

CASSETTE CONTAINING MAGNETICALLY AFFIXABLE PRINTING TAPE

BACKGROUND OF THE INVENTION

The present invention relates to cassettes which contain a magnetically affixable printing tape.

Conventionally, tape printers are widely used which print a character string on a printing tape and which cut a printed portion from the printing tape to produce a label.

Tape cassettes used in the printers contain a pair of reels around which a printing tape and an ink ribbon are wound, respectively. The printing tape includes a printing layer of a resin film with an adhesive layer coated on its side and a separable paper strip adhered to the printing layer through the adhesive layer. The tape cassette is set on the tape printer and feeds the printing tape and the ink ribbon to a printing section.

The label produced by the tape printer can be pasted on a desired object by separating its separable paper piece therefrom. Once pasted on the object, the label cannot be easily separated from the object because it strongly adheres to the object.

A magnet sheet is known, from which a smaller sheet piece of a desired size is obtained. Appropriate characters are handwritten on the smaller sheet piece, which is then affixed magnetically, for example, to a white board of steel or another magnetic object for use.

However, the conventional magnet sheet is not composed in consideration of printing in the tape printer and is not suitable for printing. Thus, tape-like magnet materials are desired from which labels are obtained on the tape printer. The inventors have made a series of studies to put to a practical use magnetically affixable printing tapes on which characters/images are printable by the tape printer.

First, in order that the magnetically affixable printing tape may be used in the tape printer like the conventional printing tape with an adhesive on its side, a magnetically affixable printing tape consisting of a printing layer and a magnetic layer pasted to the printing layer is required to be wound around a reel, and a resulting roll of the printing tape is required to be accommodated within a cassette. Since the printing tape is wound repeatedly around the reel in a superimposing manner, there may occur a trouble, for example, with conveyance of the tape depending on a magnetic pole arrangement pattern formed on the tape, as we have found. For example, a magnet sheet has magnetized lines along which the S and N poles of a particular width alternately arranged extend. A magnetically affixable tape is required to be produced appropriately from the magnet sheet by paying careful attention to the magnetized lines. If otherwise, a trouble can occur when a roll of such tape is accommodated within the tape cassette and characters/images are then printed on a tape portion fed out from the cassette.

Specifically, when the magnetically affixable printing force tape is magnetized widthwise thereof, S and N poles which extend widthwise thereof are alternately arranged longitudinally of the tape. When this tape is wound around its holding reel in superimposing relationship, the respective turns of the tape differ in diameter. Thus, poles of adjacent turns of the tape which can overlap can have the same or a different polarity depending on their winding diameters. Thus, when a force fluctuates which is required for drawing our the printing tape from the tape cassette to feed the tape to the printing section. Especially, when the radially overlapping magnetic poles of adjacent turns of the tape have the same polarity, a very large drawing force is required. In the tape printer, a conveying step motor drives the platen roller to convey the printing tape lengthwise at constant speeds while heaters of the thermal head arranged widthwise of the tape are driven to print characters/images a line at a time. When the force required for drawing the printing tape from its cassette increases to some extent, a slip can occur between the platen roller and the printing tape and the conveyance of the printing tape becomes unstable to thereby cause bad printing such as is due to a reduction in the space between the printing lines.

When the printing tape is wound around a holding reel, a magnetic layer of one turn of the tape is brought into contact with a back of a printing layer of the adjacent turn. In this case, small particles or grains of the magnetic layer, which contains a mixture of a synthetic resin or synthetic rubber and magnetic powder, would move to a surface of the printing tape to soil the same, as we found. A printer of this type generally employs a heat-transfer printing system. When inks of the conventional ink ribbon are not supposed as being used to print characters on the printing tape, characters/images printed on the tape would be blurred, which is a new problem.

The ink ribbon consists generally of a base film of capacitor paper, glassine or a resin film of polyester or a polyimide resin, and an ink layer coated on the base film. The ink layer includes a mixture of a wax or resin and a coloring agent such as a pigment. When an ink of the ink layer is transferred to the printing medium, a luster occurs on a surface of the ink-transferred to the printing medium, especially in the heat transfer system. In order to suppress this luster, a luster suppressing additive is added into the ink layer or a luster control layer is provided between the base film and the ink layer.

In many cases, a pigment added as a coloring agent to the ink layer is, for example, carbon black or an iron oxide in the case of a black ink. Similarly, the luster control layer contains an iron oxide pigment for delustering.

We also have found in a test for putting the tape to practical use that the "blurs" of the characters printed on the printing tape are due to exertion of the magnetic drawing force of the magnetic layer on the iron oxide pigment contained in the ink layer/luster control layer.

When once a label produced from the magnetic tape is affixed magnetically to a magnetic object, it is difficult to separate the former from the latter.

When the magnetically affixable printing tape contained in the tape cassette is used substantially up to its end, a small end portion of the tape is likely to remain in, be drawn against, the printer and enter a space in the printer and is difficult to remove.

SUMMARY OF THE INVENTION

It is therefore a first object of the present invention to provide a cassette which contains a magnetically affixable printing tape on which a magnetic pole arrangement pattern is formed to enable the tape printer to appropriately print characters/images on the tape without causing any troubles, for example, with the tape conveyance.

Another object of the present invention is to provide a cassette which contains a magnetically affixable tape in which no particles or grains of the magnetic layer move to a surface of the printing layer even when the printing layer is wound repeatedly along with the tape around a reel.

Still another object of the present invention is to provide a cassette which contains in combination an ink ribbon and a magnetically affixable printing tape by which no blurs occur when characters/images are printed on the tape in a heat transfer system.

A further object of the present invention is to provide a cassette which contains a magnetically affiable printing tape including a magnetic layer which provides a label which, even if it is once magnetically affixed to the object, can be easily separated from its object.

A still further object of the present invention is to provide a cassette which contains a magnetically affixable printing tape which even when it is used substantially up to its end, no small end portion of the tape remains within the tape printer and hence no troubles occur.

In order to achieve the above objects, the present invention provides a cassette comprising a holding reel around which a magnetically affixable printing tape is wound, the tape cassette being settable in a tape printer which includes convey means for conveying the tape of the cassette and printing means for printing characters/images on the tape, the tape comprising a printing layer on which characters/images are printed by the tape printer and a magnetic layer containing magnetic powder magnetized lengthwise of the tape and pasted at a side to the printing layer.

When a general magnetic printing tape is magnetized widthwise thereof and wound around its holding reel in superimposing relationship, poles of the same polarity and different polarities of adjacent turns of the tape can radially overlap depending on their winding diameters. Thus, when a large force is required to draw the printing tape out from the tape cassette to feed the tape to the printing section, the conveyance of the printing tape would become unstable. In contrast, in the present invention, the magnetic layer is magnetized longitudinally thereof. Thus, when this tape is wound around its holding reel in superimposing relationship, the poles of the same polarity of adjacent turns of the tape overlap radially, and no large force required for drawing out the tape from the tape cassette. Thus, conveyance of this printing tape is stabilized to provide satisfactory printing.

In the cassette of the present invention, a side of the magnetic layer pasted to the printing layer preferably has a coated fluororesin layer for preventing small particles or grains of the magnetic layer from moving to the printing layer when the magnetic layer comes into contact with the printing layer due to the magnetic layer and the printing layer being wound around the holding reel.

The side of the magnetic layer pasted to the printing layer may comprise a wrinkled one.

The ink of the printing ink ribbon accommodated along with the magnetically affixable in the cassette preferably contains a non-magnetic substance ink. By heat-transfer printing characters or images on the tape, using the ink ribbon, no ink transferred to the tape is magnetically drawn, and hence no printed characters/figures are blurred.

The magnetic layer has a non-magnetic area formed along at least one edge of the tape. Since a label produced from such magnetically affixable printing tape has the non-magnetized area, it can be separated at one of those areas even when it is affixed magnetically to a ferromagnet such as steel.

The cassette preferably comprises an auxiliary non-magnetic tape provided at a trailing end of the magnetically affixable printing tape and bonded to the holding reel to such a degree that the auxiliary tape is separated, or is not separated, from the holding reel of the tape printer by a conveying force exerted by the convey means as the case may be. By doing so, even when the tape is substantially used up, leaving its small end portion, which remains within the tape printer, it can be easily taken out because the auxiliary tape is attached to the printing tape end.

DETAILED DESCRIPTION OF THE INVENTION

An embodiment of the present invention will be described next with reference to the accompanying drawings.

Figure 1:
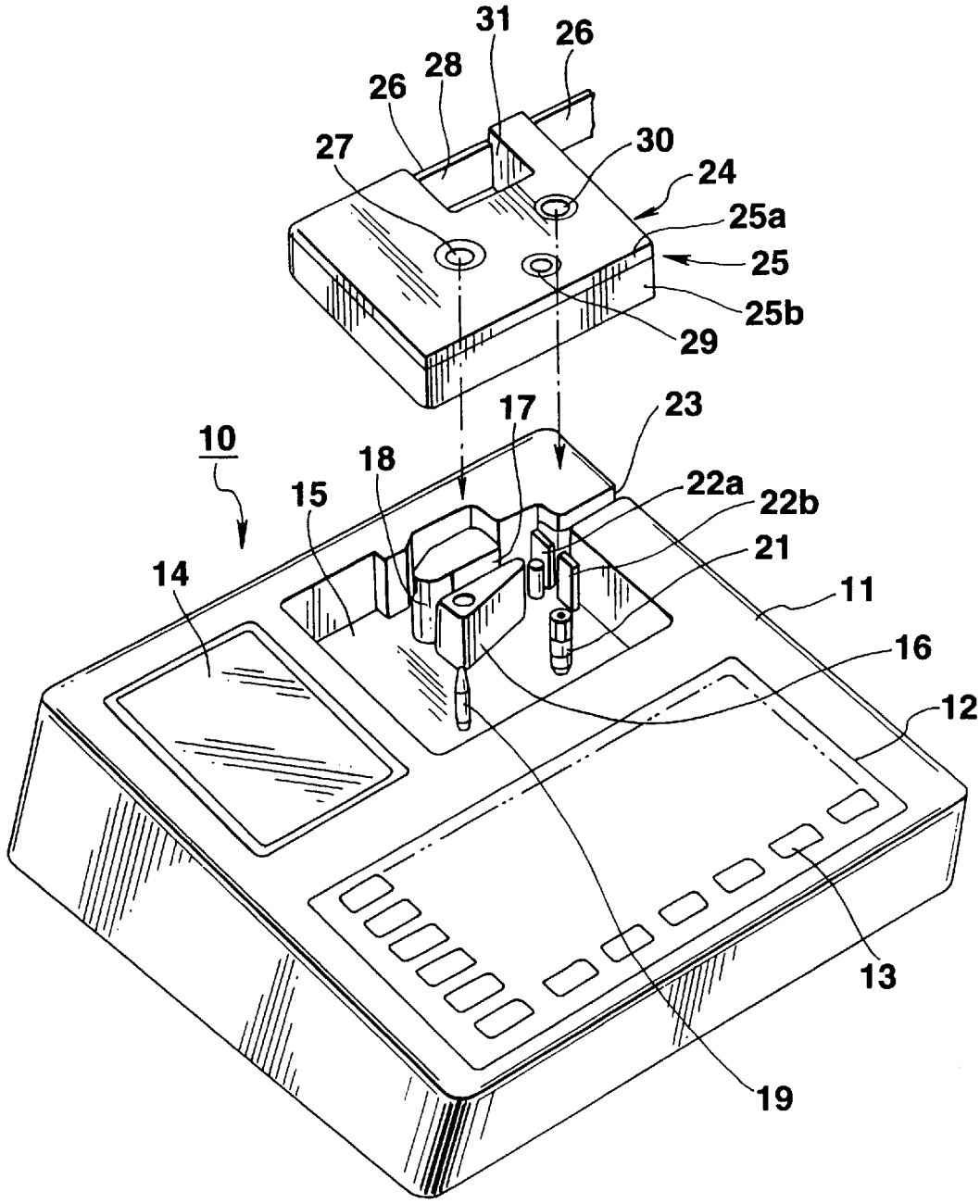
FIG. 1 is a perspective view of a cassette which contains a magnetically affixable printing tape as one embodiment of the present invention being shown as being separated from a tape printer.

Referring to FIG. 1, a cassette 24 which contains a magnetically affixable printing tape according to the present invention is shown taken out above a tape printer 10. As shown in FIG. 1, the tape printer 10 has a key-in unit 12 which includes a plurality of keys 13 to be depressed; that is, character input keys, cursor keys, a form setting key, a print key, a cancel key, function keys, a font magnification key, an enter key 13, etc., within one half of its housing 11.

A liquid crystal display unit 14 and a tape cassette accommodating section 15 are provided within the other half of the housing 11. A cover for the tape cassette accommodating section 15 is removed away such that its inside can be seen well. The tape cassette accommodating section 15 contains a swingable thermal head 16 on which a line of heaters (not shown) is arranged, and a platen roller 17 disposed opposite to the thermal head 16.

A guide plate 18, a tape winding shaft 19, an ink ribbon winding shaft 21, and a tape cutter 22 (22*a*, 22*b*) are disposed so as to surround the thermal head 16. A tape discharge exit 23 is formed to the right of the tape cutter 22.

The tape cassette 24 has a cassette case 25 composed of an upper case portion 25*a* and a lower case portion 25*b*. The cassette case 25 contains a holding reel 27 around which a magnetically affixable printing tape 26 is wound repeatedly, a ribbon holding reel 29 around which an ink ribbon 28 of a non-magnetic ink layer is wound repeatedly, and a ribbon winding reel 30 which rewinds a used potion of the ink ribbon 28.

The tape cassette 24, tape holding reel 27, ribbon holding reel 29, and ribbon winding reel 30 are made of a non-magnetic material such as a synthetic resin.

The cassette case 25 has a cut 31 which receives the thermal head 16 to which the printing tape 26 and the ink ribbon 28 are fed from the cassette case 25.

Figure 2:
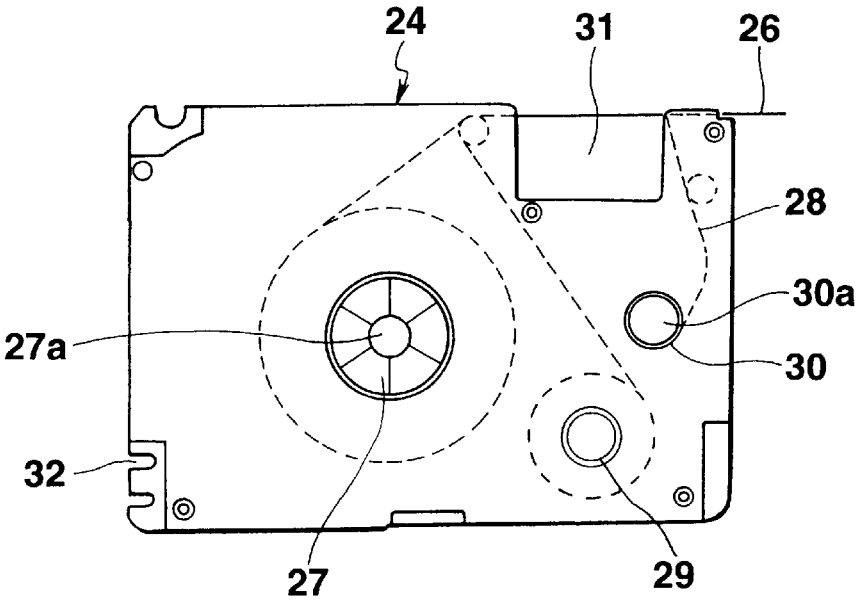
FIG. 2 is a plan view of the cassette.

As shown in FIG. 2, the cassette case 25 has a groove 32 for identifying the kind of the cassette. The tape cassette accommodating section 15 has a microswitch (not shown) to get information on the kind of the cassette represented by the groove 32.

Figure 3:
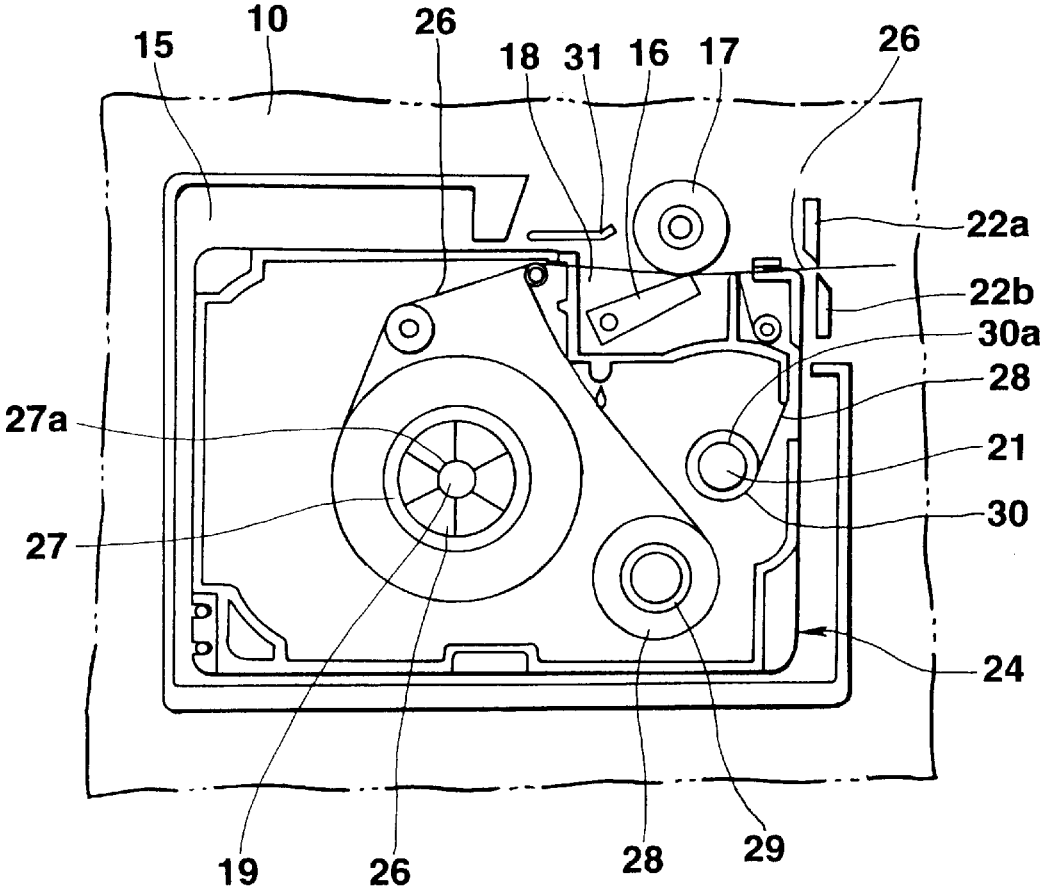
FIG. 3 illustrates the cassette set in the tape printer.

FIG. 3 illustrates the tape cassette 24, which contains the printing tape 26, set within the tape cassette accommodating section 15. In FIG. 3, the upper case portion 25*a* is removed away such that the inside of the lower case portion 25*b* can be seen well.

As shown in FIG. 3, when the tape cassette 24 is set in the tape cassette accommodating section 15, the tape winding shaft 19 is inserted into a hole 27*a* in the holding reel 27 around which the magnetic tape 26 is wound, and the ink ribbon winding shaft 21 is inserted into a hole 30*a* in the ribbon winding reel 30.

As described above, the thermal head 16 is disposed within the cut 31 in the tape cassette 24. The platen roller 17 is disposed opposite to the thermal head 16 outside the cut 31. Thus, the tape 26 and ink ribbon 28 are fed in superimposed relationship to between the thermal head 16 and platen roller 17.

No magnetic metal powder is mixed with the ink and binder in the ink ribbon 28. Also, in order to prevent a luster from occurring on the ink transferred to the tape, the ink ribbon used in the past generally uses an iron oxide (magnetic substance) pigment. In order to avoid blurs in the print in the present embodiment, a mixture of a non-magnetic coloring agent, an ink and a binder is used without using a magnetic pigment such as iron oxygen. Even when a luster appears more or less on the transferred ink on a magnetically affixable printing tape in the embodiment in the use of the tape, for example, magnetic affixation of the printed label to a white board of steel, there are no visual problems. It is experienced in a test that the addition of a non-magnetic coloring agent to the ink and binder provides a clear printed image compared to a delustered print. Of course, if necessary, dyes or non-magnetic additives may be added to the ink and binder for delustering purposes, instead of the iron oxide pigment.

The ink ribbons contained in the tape cassettes 24 include ones having a base material coated with a black ink for monochromatic printing and a base material coated with yellow, magenta and cyan color inks for color printing.

Figure 4:
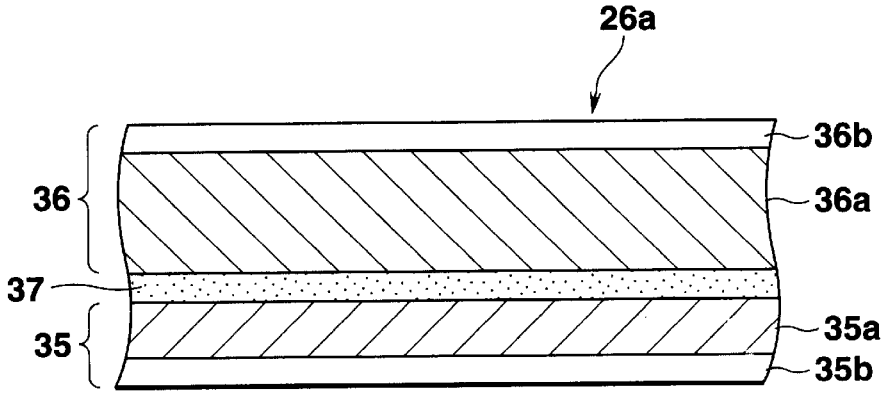
FIG. 4 is an enlarged cross-sectional view of a magnetically affixable printing tape accommodated within a cassette.
Figure 5:
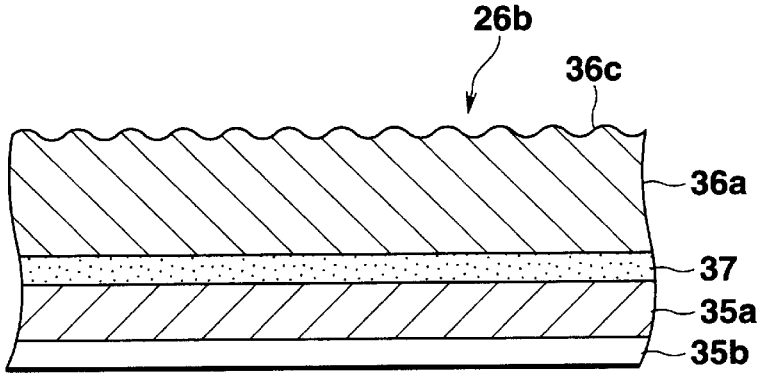
FIG. 5 is an enlarged cross-sectional view of another magnetically affixable printing tape contained in a cassette.

FIGS. 4 and 5 are enlarged cross-sectional views of different magnetically affixable printing tapes 26*a* and 26*b* each contained in the tape cassette 24. The printing tape 26*a* of FIG. 4 includes a printing layer 35 and a magnetic layer 36 pasted through an adhesive layer 37 to the printing layer 35. The printing tape 26*a* of FIG. 5 and the ink ribbon 28 are fed to the printing section of the tape printer 10 such that the printing layer 35 is superimposed on the ink ribbon 28 to thermally print characters/images on the printing layer 35. The printing layer 35 has a polyester layer 35*b* coated on a film, for example, of a PET resin about 40 μm thick to improve its printability (ink receptivity).

The magnetic layer 36 is made of a sheet-like magnetic substance layer 36*a* 100–300 μm thick and a fluorine layer 36*b* coated on the layer 36*a*. The materials of the magnetic layer 36 include a mixture of a resin such as a polyethylene chloride or a rubber macromolecule such as natural rubber, neoprene, isopreme, NBR (nitro butadiene rubber) or SBR (styrene butadiene rubber) and ferromagnetic powder, for example, of magnetite, ferrite or a cobalt oxide.

The layers 35 and 36 are bonded through an acrylic adhesive layer 37 such that the respective surface layers 35*b* and 36*b* face outward. The half-finished product is then magnetized in a strong magnetic field to complete the magnetically affixable printing tape 26*a*.

Alternatively, the magnetic layer 36 itself may be cut away from a magnetic substance sheet and then pasted through an acrylic adhesive layer 37 to a back of the resin film 35*a*. For example, resin magnetic tapes include composite resin magnet materials which contain as a binding agent a thermoplastic resin such as nylon polypropylene, polyethylene, polyethylene chloride or vinyl acetate. One of those materials is thermally pressed with a press roller to make uniform the magnetizing directions of grains of ferromagnetic powder contained in the material perpendicular to a surface of the sheet to thereby form a magnetic tape. The ferromagnetic powder includes Ba or Sr ferrite powder, Alnico magnet (Se—Cr—Co) powder, rare earth cobalt magnet powder and rare earth iron magnet powder, as well known.

More specifically, for example, a mixture of a polyamide resin having a melting viscosity of 30–50 Poise at 200° C. and 80–90 weight % of barium ferrite powder and 0.1–1 weight % of zinc stearate or polyethylene wax is kneaded at a temperature of 150–180° C., and then pressed so as to have a thickness of 0.1–0.5 mm. The resulting half-finished product is immediately put in an orienting magnetic field of 10000 Oersted by a magnetizer, and then cooled to provide a magnet sheet, which has 700–1600 G (Gauss) as a surface magnetic flux density, which is usable as the printing tape in the present invention.

The magnetically affixable printing tape 26*b* of FIG. 5 is the same in composition as the tape 26*a* of FIG. 4 in that they include PET resin film 35*a*, its surface layer 35*b*, acrylic adhesive layer 37, and magnetic substance layer 36*a*, excluding a wrinkled surface layer 36*c* formed on the magnetic substance layer 36*a* instead of a coated fluorine layer.

Figure 6:
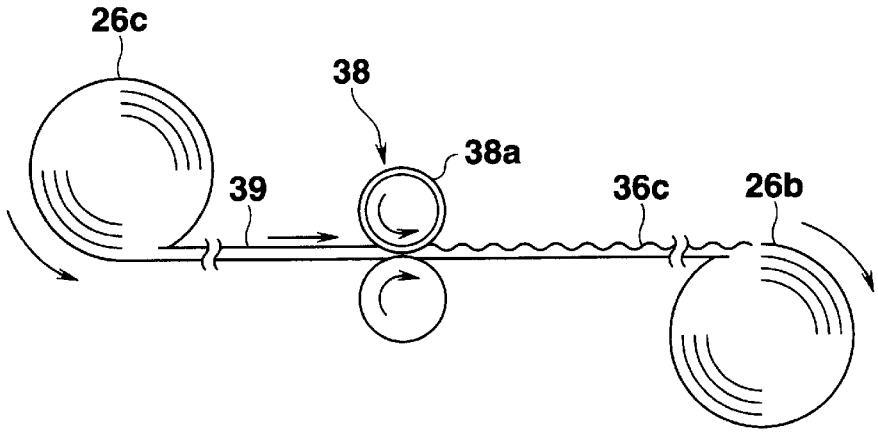
FIG. 6 schematically illustrates forming wrinkles with rolls on the magnetic tape.

As shown in FIG. 6, the preproduced tape 26*c* composed of PET resin film 35*a*, its surface layer 35*b*, acrylic adhesive layer 37, and magnetic substance layer 36*a* is passed through a pair of press rollers 38, one of which (in this example, 38*a*) has a wrinkled surface, and pressed such that a smooth surface 39 of the tape 26*c* is changed to a wrinkled surface 36*c*. The tape 26*b*, thus obtained, is wound around a holding reel 27 and accommodated in a cassette case 25, as shown in FIG. 3.

Alternatively, without pressing the preproduced tape 26*c* with the pair of rollers, the tape may be wrinkled in the finishing step subsequent to the pasting step or a magnetic substance sheet (magnetic substance layer 36*a*) only may be previously wrinkled and then pasted to other layers, as shown in FIG. 6.

The wrinkling is not only performed by the above pressing step. For example, a surface of the magnetic substance layer 36*a* may be processed with appropriate chemicals so as to form a coarse surface.

The reason why the surface of the magnetic substance layer 36*a* is coated with fluorine or wrinkled, as shown in FIG. 4 or 5, is to prevent "blocking" which would otherwise occur after the magnetic substance layer 36*a*, thus obtained, is wound around the holding reel 27 and then put in the tape cassette 24, as shown in FIG. 3, as clarified experimentally.

The "blocking" implies that as the printing tape 26 is wound around the holding reel 27, grains of magnetic powder contained in a dispersive manner in the magnetic substance layer 36*a* are combined with, and move to, a printing surface (of an improved ink-receptivity surface layer 35*b*) which is wound sequentially along with the magnetic layer 36*a* to be brought into contact with the magnetic substance layer 36*a*. Once such blocking occurs, the printing tape surface would be soiled, an appropriate print image could not be formed, and its image quality would be deteriorated.

According to the present invention, by coating a surface of the magnetic substance layer 36*a* with fluorine to confine the magnetic powder to within the magnetic layer 36*a*, as described above, the occurrence of the blocking is prevented with high reliability.

Only by forming wrinkles on the surface of the magnetic layer 36*a* instead of coating the same with fluorine, blocking is prevented from occurring, as we formed. It has also been found that irregularities of a surface of the magnetic layer 36*a* due to the wrinkling step are preferably coarser than those of the surface of the improved ink-receptivity surface layer 35*b* as the printing surface to prevent the occurrence of the blocking.

When the printing tape is produced, first, a magnet sheet (magnetic substance sheet) is produced or a commercially available magnet sheet is gotten and worked so as to provide a tape. The magnet sheet has magnetized lines along which magnetic poles S and N arranged alternately extend.

Unless a tape is produced from the magnet sheet by paying appropriate attention to the magnetized lines, the following trouble would occur substantially when the finished magnetically affixable printing tape 26 is wound around the holding reel 27 and then accommodated within the tape cassette 24.

Figure 7:
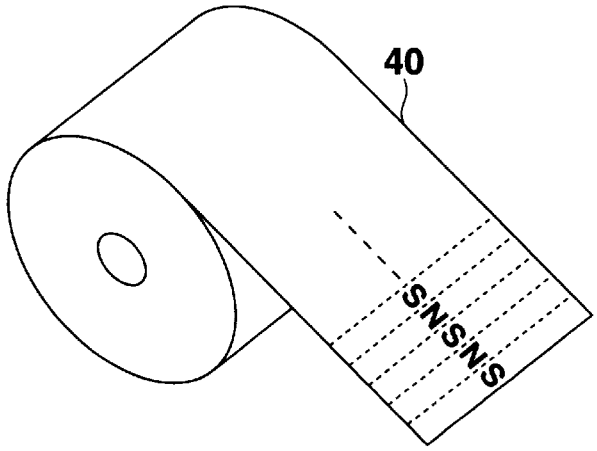
FIG. 7 is a perspective view of a tentatively produced magnetically affixable printing tape wound around a holding reel.
Figure 8:
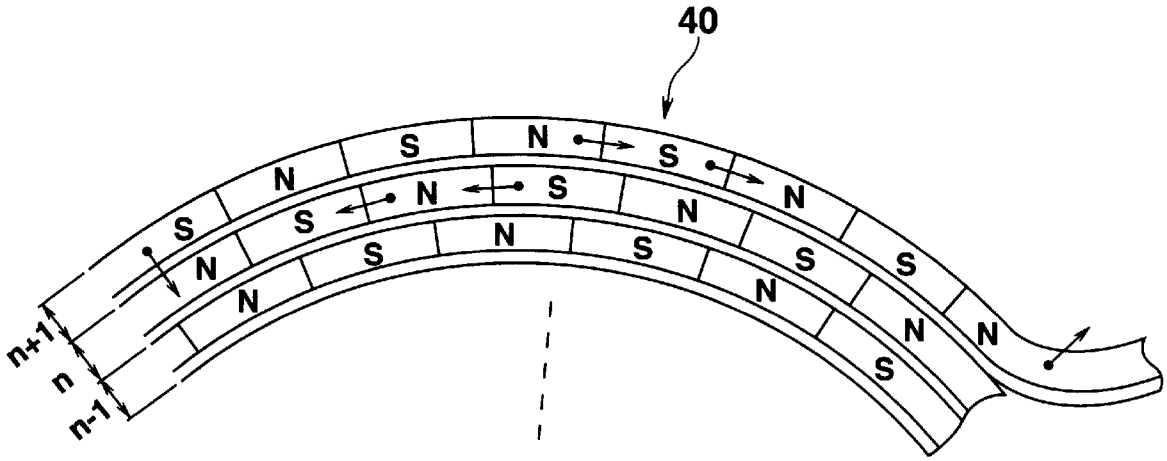
FIG. 8 intelligibly illustrates in cross section only three of turns of the magnetically affixable printing tape wound around the holding reel.

FIG. 7 is a perspective view of a tentatively produced magnetically affixable printing tape 40 which is wound around the reel 27. FIG. 8 illustrates in cross section taken-out (n−1) th, nth, (n+1) th turns of the printing tape 40 in order to facilitate the understanding. As shown in FIG. 7, in this example, the whole tape 40 is magnetized such that the magnetized lines of the tape 40 are directed widthwise of the tape.

FIG. 8 illustrates a trouble which may occur in this case. More specifically, as described above, the magnetized lines of the tape 40 is directed widthwise of the tape. In addition, the respective diameters of the turns of the printing tape 40 wound around the holding reel 27 vary depending on the diameters of their turns. Thus, respective adjacent poles of any two adjacent turns which are superimposed radially can be of the same or opposite polarity. Thus, for example, the situation of FIG. 8 can occur in which some N, S and N poles of an nth turn of the tape are driven counterclockwise, as shown by leftward arrows, the leftmost S pole of an adjacent (n+1)th turn is driven toward the center of the reel, as shown by a radially inward arrow, some other N, S and N poles of the (n+1)th turn are driven clockwise, as shown by rightward arrows, and the rightmost N pole of the (n+1)th turn is driven radially outward, as shown by a corresponding arrow.

Therefore, when the printing tape 40 is fed out from the tape cassette 24 set in the tape printer 10 to the printing section, the back tension is uneven and the force required for pulling out the printing tape 40 fluctuates to thereby render unstable the conveyance of the magnetic force printing tape 40 to thereby provide unsatisfactory printing.

Figure 9:
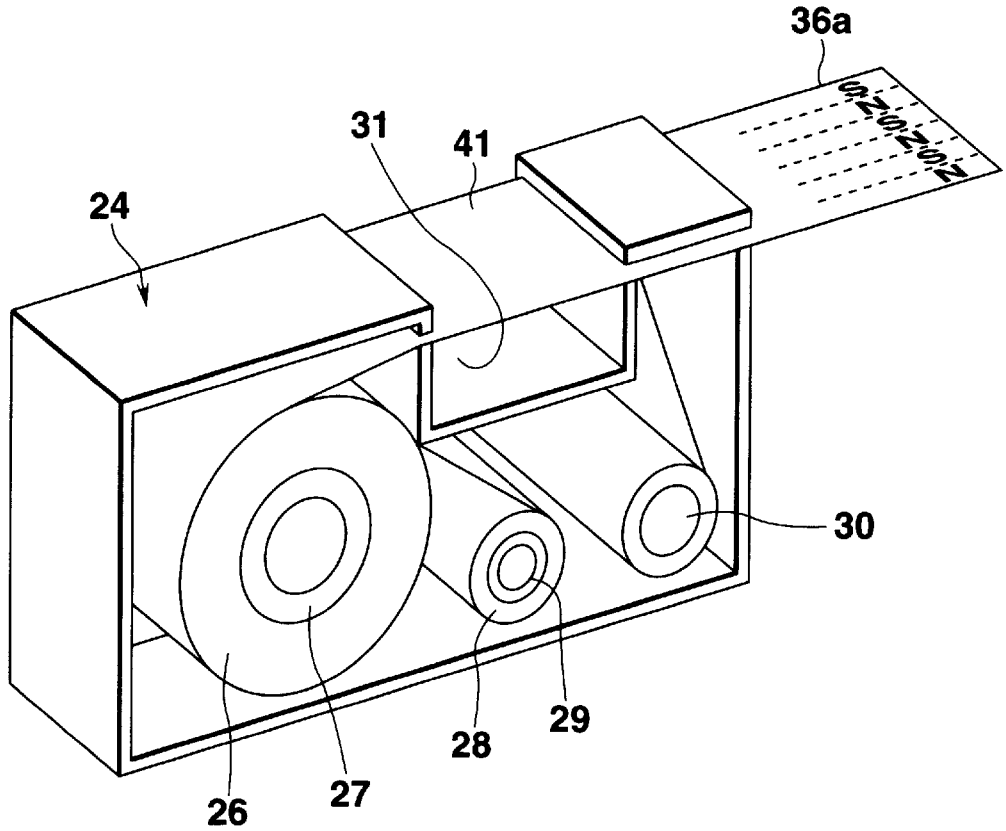
FIG. 9 is a perspective view of the cassette.
Figure 10:
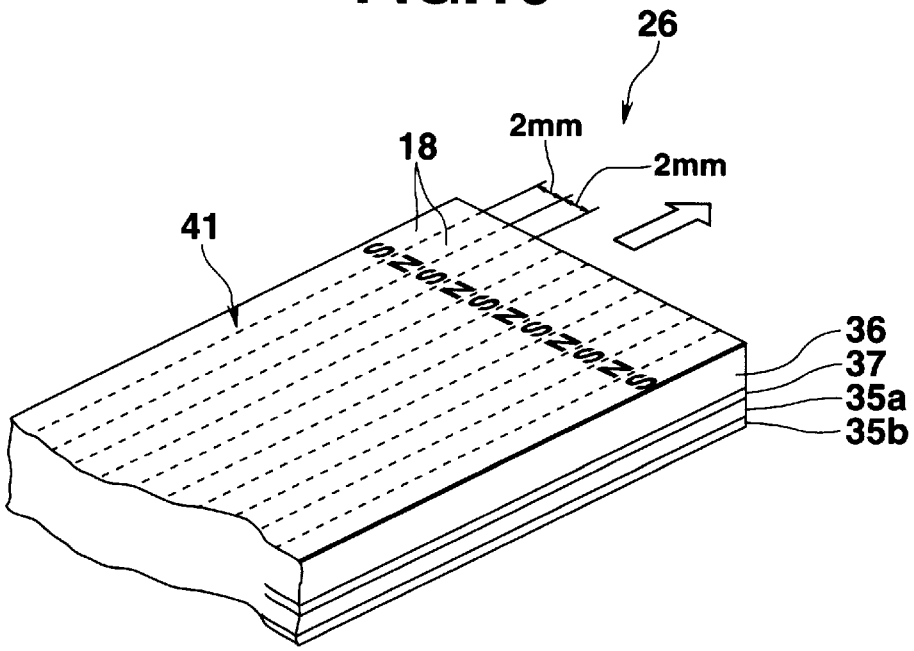
FIG. 10 illustrates the compositions of a magnetically affixable printing tape and especially its magnetic layer according to the present invention accommodated in the cassette of FIG. 9.

However, this trouble is solved by the present invention, which will be described next. FIG. 9 is a perspective view of the tape cassette with its upper case portion being removed away to illustrate the magnetically affixable printing tape accommodated within the tape cassette. FIG. 10 illustrates the composition of the magnetic layer (magnetic substance layer) of the magnetically affixable printing tape to be accommodated within the tape cassette of FIG. 9.

Since the tape of FIG. 9 is the same in composition as that of FIG. 4, excluding the magnetic substance layer, the corresponding elements of FIGS. 9 and 4 are identified by the same reference numeral. Similarly, since the tape cassette of FIG. 9 is the same in composition as that of FIG. 3, the corresponding elements of FIGS. 9 and 3 are identified by the same reference numeral.

As shown in FIG. 9, S and N poles having a 2 mm width which extend lengthwise of a magnetically affixable printing tape 26 are alternately arranged widthwise on a magnetized surface 41 of a magnetic layer 36*a* of the tape 26. Thus, even when the printing tape 26 is wound repeatedly around the holding reel 27 in superimposing relationship, no large force is required for drawing the tape 26 from the cassette 24 unlike the case of FIG. 8 where poles of different polarities of the adjacent turns of the tape overlap.

Figure 11:
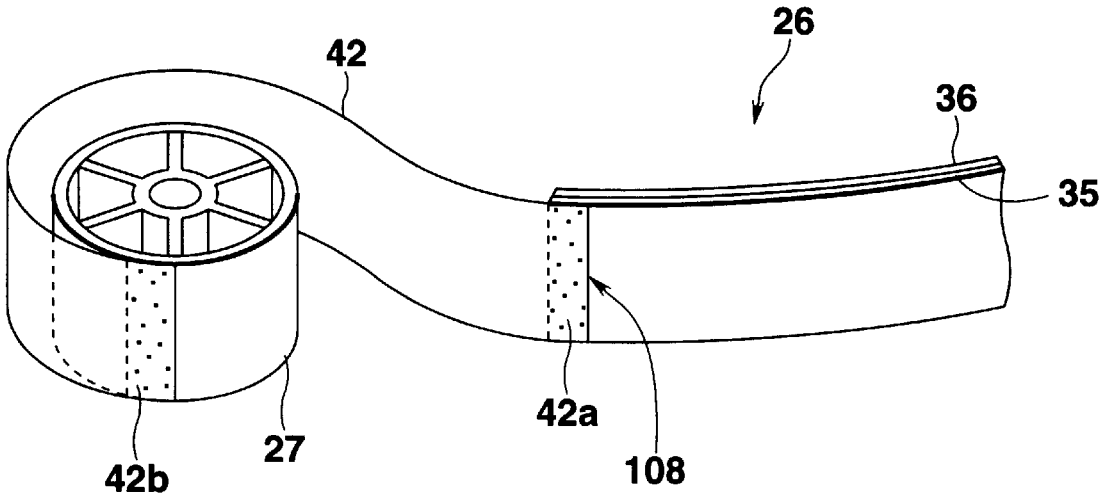
FIG. 11 illustrates connection of the magnetically affiable printing tape to the reel through an auxiliary tape.

Thus, the tape 26 can be drawn out from the tape cassette 24 with a relatively small force, stabilized conveyance of the tape is performed, and satisfactory printing is achieved without bad printing such as is due to a reduction in the space between the printing lines As shown in FIG. 11, the tape 26 is fixed at an end to one end 42*a* of an auxiliary tape 42 with an adhesive. The auxiliary tape 42 is temporarily fixed at the other end to the holding reel 27 with a weak adhesive agent or tape to such a degree that when the tape 26 is driven by the platen roller 17 in a pressed state between the platen roller 17 and the thermal head 16, the tape 26 is separated from the auxiliary tape 42. The auxiliary tape 42 is made of a non-magnetic synthetic resin. Preferably, the length of the auxiliary tape 42 exceeds at least the distance between the thermal head 16 and the cutter 22 or at least the distance between the thermal head 16 and the tape discharge exit 23 such that even when the tape 26 is used substantially up to its end with an end portion of the tape 26 remaining within the printer due to the cutting operation, the tape end portion is easy to take out from the tape printer because the tape end potion is fixed to the auxiliary tape 42.

Alternatively, the auxiliary tape 42 may be bonded at its other end 42*b* strongly to the tape holding reel 27 to such a degree that the auxiliary tape 42 is not separated from the reel 27 by the tape conveying force applied by the platen roller 17 thereto. In that case, the length of the auxiliary tape 42 preferably exceeds at least the distance between the holding reel 27 and the cutter 22 or at least the distance between the reel 27 and the tape discharge exit 23 in a state where the tape cassette 24 is set within the tape cassette accommodating section 15.

By doing so, finally, since the end portion of the tape 26 can be taken necessarily out of the tape printer in a state is pasted to the auxiliary tape 42, it does not enter the printing mechanism.

Alternatively, only a printing layer 35 may be provided at the end of the magnetically affixable printing tape 26, and pasted to the tape holding reel 27 without providing the auxiliary tape 42 and the magnetic layer 36.

Figure 12:
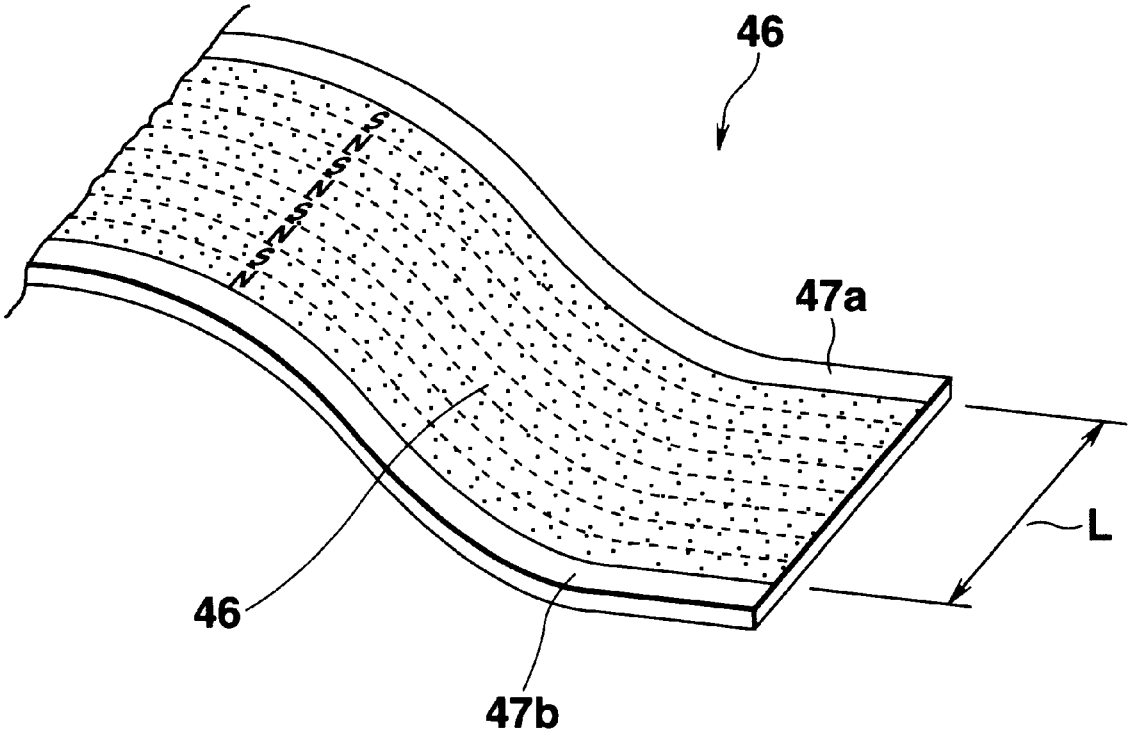
FIG. 12 illustrates another magnetically affixable printing tape according to the present invention.

FIG. 12 shows a part of a back (magnetized surface) of a magnetically affixable printing tape of another example. In FIG. 12, reference numeral 46 denotes a magnetized area where a magnetic pole arrangement pattern is formed, as in FIG. 9. Reference numerals 47*a* and 47*b* each denote a non-magnetized edge.

Only the magnetized area of a width L can be formed by a strong magnetic field or by forming a magnetic substance containing polymer material on a portion of the base film having the width L. The non-magnetized area may be provided at one of the side edges 47*a* and 47*b*. In either of both the cases, when a magnetically affixable printing tape, for example, affixed magnetically to a white board of steel is to be separated from same, a side edge of the tape is easily picked up by fingers.

Figure 13:
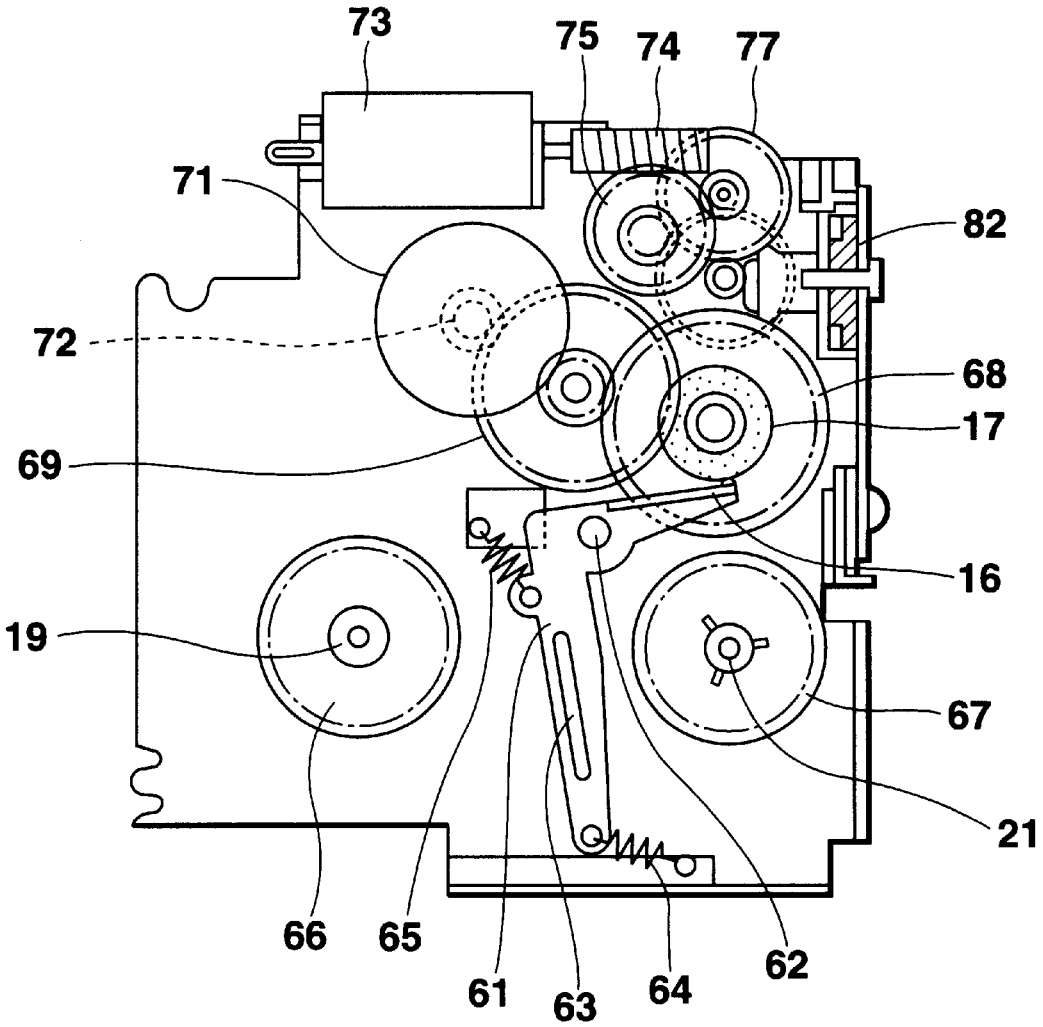
FIG. 13 is a plan view of a driving mechanism for the tape printer.
Figure 14:
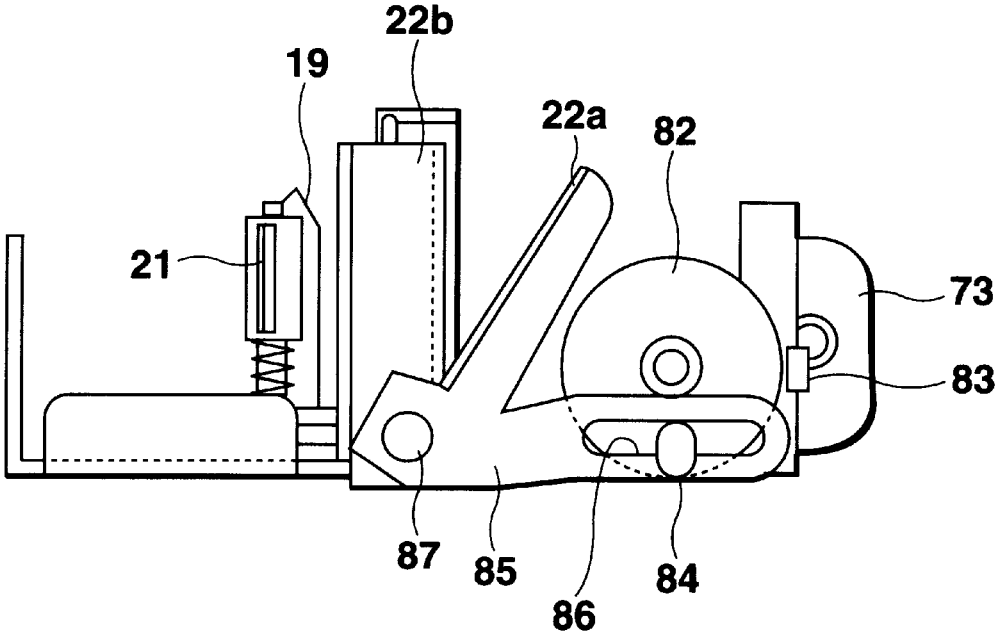
FIG. 14 is a side view of the driving mechanism.
Figure 15:
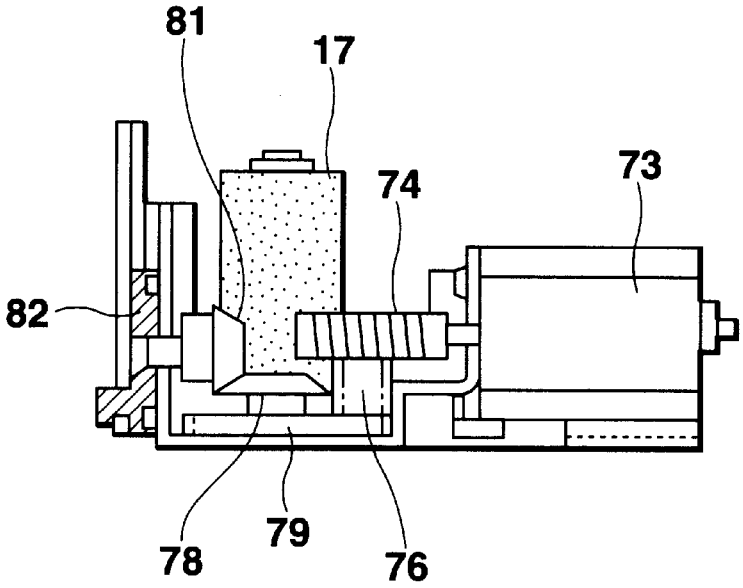
FIG. 15 is another side view of the driving mechanism.

A driving mechanism of the tape printer of FIGS. 1 and 3 will be described next. FIGS. 13–15 show the driving mechanism for the elements of the tape printer of FIGS. 1 and 3. FIG. 13 is a plan view of the driving mechanism, and FIGS. 14 and 15 are each a side view of the driving mechanism. The driving mechanism of FIGS. 13–15 is arranged below the bottom, or in the vicinity of, the tape cassette accommodating section 15 in the FIG. 1 housing 11. FIGS. 13–15 show the thermal head 16, platen roller 17, tape winding shaft 19 and ink ribbon winding shaft 21 of FIG. 1 in order to illustrate the positional relationship between each of those elements and the driving mechanism.

The thermal head 16 and a head arm 61 compose an L-like member which is pivoted at a point 62 in the vicinity of its corner. The head arm 61 has an elongated slot 63 in which a cam pin (not shown) is slidablly received. The head arm 61 is biased counterclockwise by a tension spring 64 which extends between a free end of the head arm 61 and a housing frame. A tension spring 65 is provided between the vicinity of the corner of the L-like member and the housing frame so as to bias the head arm 61 clockwise.

As the cam (not shown) is driven so as to leftward move its pin received slidably in the slot 63, the head arm 61 and hence the thermal head 16 are turned clockwise around the pivot 62, and the thermal head 16 is moved to a non-printing position. When the cam is driven so as to rightward move the pin in the slot 63, the thermal head 16 is turned counterclockwise around the pivot 62 such that the thermal head 16 is pressed at its printing unit (a heater array) provided at its free end against the platen roller 17 through the printing tape 26 and ink ribbon 28.

The tape winding shaft 19 is engaged with a gear 66 which is coupled to a drive system (not shown), and rotated only when the tape is returned back to its print starting position in the color printing operation. The ink ribbon winding shaft 21 is engaged with a gear 67 which is coupled to a drive system (not shown), and rotated.

The platen roller 17 includes a platen gear 68 which is engaged with a smaller gear of a speed changing gear unit 69, which has a larger gear meshing with a drive gear 72 of a tape feed motor 71.

A tape cut driving mechanism is provided, which includes a DC motor 73 which has a drive shaft fixed to a worm 74 which meshes with a worm wheel 75. A smaller gear integral with the worm wheel 75 meshes with a spur gear 79 integral with a bevel gear 78, which meshes with another bevel gear 81. Thus, the rotations of the bevel gear 78 driven by the DC motor 73 in a horizontal plane are converted to those of the bevel gear 81 in a vertical plane. A cutter cam 82 is coaxially coupled to the bevel gear 81. A micro switch 83 is provided on a printer frame in contact with the periphery of the cutter cam 82. The micro switch 83 detects the initial position of the cutter cam 82 based on a recess provided at a predetermined position on the periphery of the cutter cam 82 and delivers its detection signal to a controller 90 to be described later.

A pin 84 provided on a periphery of the cam 82 to assume its lowest position when the cutter cam 82 is at its initial position is slidably received in a slot 86 in a turning arm 85 integral with a movable blade edge 22*a* of the tape cutter 22 with a free end of the pin 84 which extends through the slot 86 being bent outside the slot 86 such that the pin is not disengaged from the slot 86. As described above, when the cutter cam 82 is rotated counterclockwise via the worm 74, worm wheel 75, smaller gear 76, reduction gear 77, spur gear 79, and bevel gears 78 and 81, the turning arm 85 of the tape cutter 22 is turned counterclockwise and then clockwise by the pin 84 in a vertical plane around the pivot 87 to thereby close/open the movable blade edge 22*a* against/from away the fixed blade edge 22*b* of the tape cutter 22 to cut a tape portion away.

Figure 16:
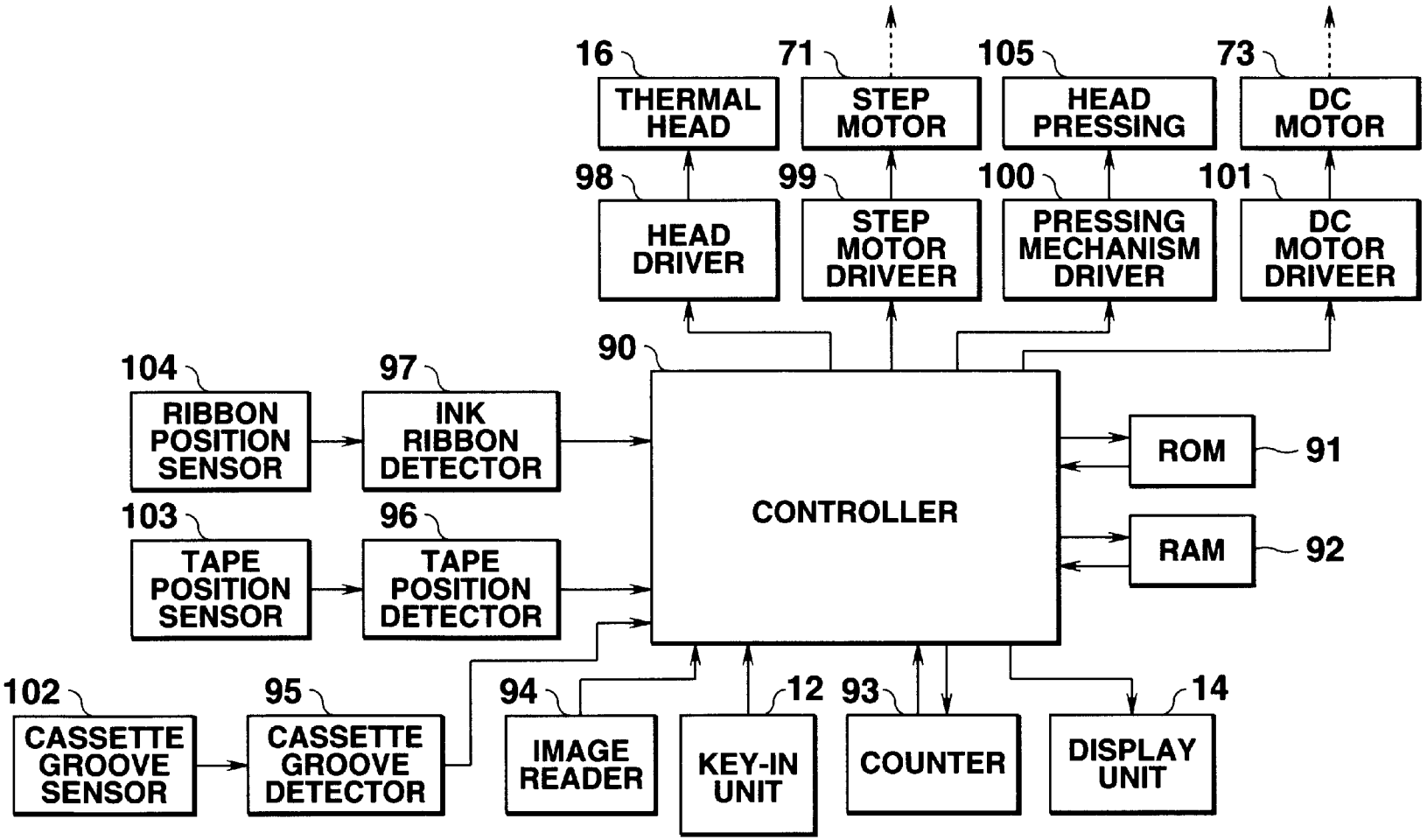
FIG. 16 is a block diagram of an electronic circuit of the tape printer.

Referring to FIG. 16, the controller 90 includes a CPU which is connected to the display unit 14 and the key-in unit 12 shown in FIG. 1. The CPU is connected to a ROM 91, a RAM 92, a counter 93, an image reader 94, a cassette groove detector 95, a tape position sensor 96, an ink ribbon sensor 97, a head driver 98, a step motor driver 99, a pressing mechanism driver 100 and a DC motor driver 101.

ROM 91 contains programs which control the operation of the tape printer 10. The controller 90 controls the operation of the respective elements of the printer based on a program read from ROM 91.

RAM 92 contains an image data area, a print data area, a flag area, a register area, a counter area, a work area, etc., (not shown), which temporarily store predetermined data under control of the controller 90.

The counter 93 sequentially increments its initial set value to generate serial numbers when characters/image are printed.

The image reader 94 includes a scanner composed of a CCD (charge coupled device). It reads and outputs an image, for example, of a face photograph for label printing. The cassette groove sensor 102 senses a cassette identification groove 32 formed in the tape cassette 24 which contains the printing tape 26, and provides a corresponding sensed signal to the cassette groove detector 95, which receives the sensed signal and delivers it to the controller 90.

The tape position detector 96 is connected to a tape position sensor 103. The tape position sensor 103 senses respective position marks attached to the printing tape 26 to determine the print starting positions for the respective colors.

The ink ribbon detector 97 is connected to the ribbon position sensor 104, which senses the respective positions where the characters/images are printed in yellow, magenta and cyan in the full color printing to output corresponding sensed signals.

The head driver 98 is connected to the thermal head to heat same under control of the controller 90.

The motor driver 99 drives the tape feed or step motor 71 to thereby drive the platen roller 17, tape winding shaft 19 and ribbon winding shaft 21 through a gear chain and a clutch mechanism (not shown).

The pressing mechanism driver 100 is connected to a head pressing mechanism 105 comprised of a motor or a solenoid. The pressing mechanism driver 100 drives the head pressing mechanism 105 forwardly or backwardly. In printing, it turns and presses the thermal head 16 to and against the platen roller 17. When the printing tape 26 is fed backwardly to superimpose three prime colors in the full color printing or the printing is terminated, the pressing mechanism driver 100 turns the thermal head 16 away from the platen roller 17.

The DC motor driver 101 drives the DC motor 73 to operate the cutter 22.

Figure 17:
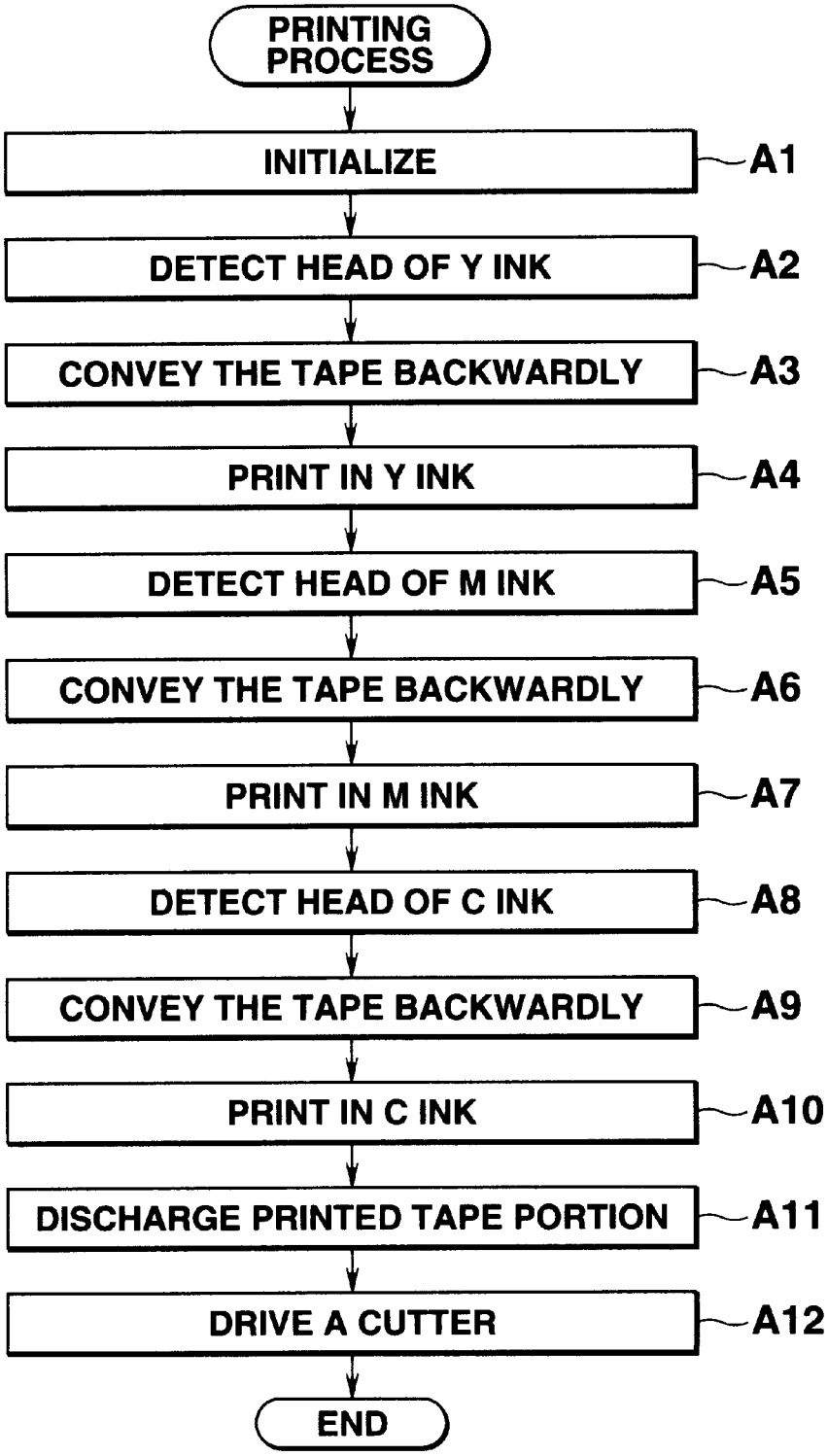
FIG. 17 is a flowchart of a color printing process performed by the tape printer.

Operation of the tape printer 10 in color printing will be described next with respect to FIG. 17 which is a flowchart of a printing process performed by the tape printer. This operation is started by depressing the print key of the key-in unit 12 (step A1).

When the printing section prints data stored in the RAM 92 in colors, first, the head of an yellow ink contained in the ink ribbon 28 is detected (step A2). More specifically, the ink ribbon winding shaft 21 and the platen roller 17 are rotated by the step motor 71 to convey the ink ribbon 28 and the printing tape 26 together. The ribbon position sensor 104 senses a head indicating mark of the ink ribbon 28 to thereby terminate this process. In this process, a quantity of conveyance of the magnetically affixable printing tape 26 and the ink ribbon 28 is counted based on the output from the tape position sensor 103 which includes an optical sensor. A plurality of position marks (not shown) are preprinted lengthwise at equal intervals the magnetic layer 36. When the tape 26 passes by the tape position sensor 103 placed at a fixed position, the tape position sensor senses the respective position marks. Thus, a conveyance quantity counter (not shown) provided in the RAM 92 counts the number of position marks sensed.

After the head of the Y ink is detected, the thermal head 16 is released from the platen roller 17, the tape winding shaft 19 is rotated, and only the tape 26 is conveyed backwardly through a distance (step A3) which corresponds to the conveyance quantity counter in the RAM 92 counting down from its present count to zero based on the output signals from the tape position sensor 103.

The thermal head 16 is then pressed against the platen roller 17 through the ink ribbon 28 and the printing tape 26. In this state, the thermal head driver 98 causes the heaters of the thermal head 16 to produce heat in accordance with print data stored in the RAM 92 to thereby transfer the Y ink of the ink ribbon 28 thermally to the printing tape 26. The step motor driver 99 then drives the step motor 71 to rotate the platen roller 17 and the ink ribbon winding shaft 21 to thereby convey the ink ribbon 28 and the tape 26 downstream to the next printing position. In this way, the printing of one line by the thermal head 16 and downward conveyance of the ink ribbon 28 and the printing tape 26 are repeated until an image is printed in the Y ink lengthwise on the tape 26. The quantity of conveyance of the tape 26 is counted up based on the output from the tape position sensor 103 in this Y ink printing, and stored in the conveyance quantity counter (step A4).

Subsequently to the termination of the image printing in Y ink color, the tape 26 and the ink ribbon 28 are further conveyed downstream while the head of the magenta ink is being detected. Also in this case, the quantity of conveyance of the tape 26 is counted up based on the output from the tape position sensor 103, the count, thus obtained, is added to the count produced in the Y ink printing, and the resulting count is then stored in the conveyance quantity counter (step A5).

Then, the thermal head 16 is released from the platen roller 17, the ribbon winding shaft 19 is rotated, and only the printing tape 26 is conveyed backwardly through a distance (step A6) which corresponds to the conveyance quantity counter in the RAM 92 counting down from its present count to zero based on the output signals from the tape position sensor 103.

The thermal head 16 is then pressed against the platen roller 17 through the ink ribbon 28 and the printing tape 26 for one line printing. In this state, the thermal head driver 98 causes the heaters of the thermal head 16 to produce heat in accordance with print data stored in the RAM 92 to thereby transfer the M ink of the ink ribbon 28 to the printing tape 26. The step motor driver 99 then drives the step motor 71 to rotate the platen roller 17 and the ink ribbon winding shaft 21 to thereby convey the ink ribbon 28 and the tape 26 downstream to the next one-line printing position. In this way, the printing of one line by the thermal head 16 and downward conveyance of the ink ribbon 28 and the printing tape 26 are repeated such that the M color print data is printed lengthwise in the Y ink printed area on the tape 26 in superimposed relationship (step A7).

Subsequently, the head of the cyan C ink is detected (step A8). The tape 26 is backwardly conveyed upstream by the same quantity as the tape 26 was conveyed downstream in the Y and M ink printing processes (step A9).

The cyan ink print data is also printed in the same printing area of the tape 26 in superimposing relationship to the yellow and magenta ink print data in a manner similar to those in which those data were printed (step A10).

When the cyan ink print data has been printed in superimposing manner, the step motor driver 99 drives the step motor 71 to convey the tape 26 to thereby discharge its printed tape potion out of the printer (step All). The DC motor driver 101 drives the DC motor 73 in this state to actuate the cutter 22 to cut the printed tape potion from the tape 26 (step A12). Thus, the process for obtaining a color print from the printing tape 26 is terminated.

What is claimed is:

1. A printing tape cassette adapted to be set on a tape printer which includes a printing unit and a conveying unit, said printing tape cassette comprising:

a cassette case;

a holding reel contained within the cassette case; and a printing tape wound around the holding reel and contained within the cassette case;

wherein the printing tape comprises a printing layer on which characters/images can be printed by the printing unit of the tape printer, a magnetic layer of magnetic powder magnetized lengthwise with respect to the printing tape such that a plurality of strip-like S and N poles extending through the length of the printing tape are arranged alternately widthwise thereof, and an adhesive layer provided between the printing layer and the magnetic layer for adhering the printing layer and the magnetic layer to each other;

wherein the printing tape is pastable magnetically to a ferromagnetic object based on a magnetic force produced by the magnetic layer; and wherein the printing tape is arranged to be fed by the conveying unit of the tape printer from the cassette case to the printing unit of the tape printer.

2. The cassette according to claim 1, wherein a coated resin layer is provided on a side of the magnetic layer opposite to a side thereof which is adhered to the printing layer, said coated resin layer preventing small particles and grains of the magnetic layer from moving to and being deposited on the printing layer when the magnetic layer comes into contact with the printing layer due to the magnetic layer and the printing layer being wound around the holding reel.

3. The cassette according to claim 2, wherein the coated resin layer comprises a fluorine resin.

4. The cassette according to claim 1, wherein a side of the magnetic layer, opposite to a side thereof which is adhered to the printing layer, is wrinkled to prevent small particles and grains of the magnetic layer from moving to and being deposited on the printing layer when the magnetic layer comes into contact with the printing layer due to the magnetic layer and the printing layer being wound around the holding reel.

5. The cassette according to claim 1, further comprising a printing ink ribbon which contains a non-magnetic substance ink, said printing ink ribbon being contained within the cassette case and being drawn in an overlapping manner on the magnetic layer by the conveying unit of the tape printer from the cassette case and fed to the printing unit of the tape printer.

6. The cassette according to claim 1, wherein the magnetic layer comprises a non-magnetic area formed along at least one edge of the printing tape.

7. The cassette according to claim 1, further comprising a non-magnetic auxiliary tape provided at a trailing end of the printing tape and bonded to the holding reel with a bonding force that is smaller than a force exerted by the conveying unit of the tape printer on the auxiliary tape to separate the auxiliary tape from the holding reel when the printing tape is conveyed by the conveying unit of the tape printer toward the printing unit of the tape printer.

8. The cassette according to claim 1, further comprising a non-magnetic auxiliary tape provided at a trailing end of the printing tape and bonded to the holding reel with a bonding force that is greater than a force exerted by the conveying unit of the tape printer on the auxiliary tape to separate the auxiliary tape from the holding reel when the printing tape is conveyed by the conveying unit of the tape printer toward the printing unit of the tape printer.

* * * * *